US006830099B2

(12) United States Patent
Moeykens

(10) Patent No.: US 6,830,099 B2
(45) Date of Patent: Dec. 14, 2004

(54) FALLING FILM EVAPORATOR HAVING AN IMPROVED TWO-PHASE DISTRIBUTION SYSTEM

(75) Inventor: Shane A. Moeykens, Grantham, NH (US)

(73) Assignee: American Standard International Inc., New York, NY (US)

( * ) Notice: Subject to any disclaimer, the term of this patent is extended or adjusted under 35 U.S.C. 154(b) by 97 days.

(21) Appl. No.: 10/319,362

(22) Filed: Dec. 13, 2002

(65) Prior Publication Data

US 2004/0112573 A1 Jun. 17, 2004

(51) Int. Cl.[7] ..... F28D 3/04

(52) U.S. Cl. ..... 165/115; 165/118; 62/84; 62/471; 261/97; 159/13.3

(58) Field of Search ..... 62/84, 525, 471; 261/97; 165/118, 159, 115; 26/97, 110; 159/13.2, 27.4, 13.3, 6.3

(56) References Cited

U.S. PATENT DOCUMENTS 2,873,140 A 2/1959 Merrick
3,146,609 A * 9/1964 Engalitcheff Jr. ..... 62/305
3,849,232 A * 11/1974 Kessler et al. ..... 159/13.2
4,134,939 A * 1/1979 Zardi et al. ..... 261/112.1
4,248,296 A 2/1981 Jezek
4,264,538 A * 4/1981 Moore et al. ..... 261/97
4,816,191 A * 3/1989 Berven et al. ..... 261/97
5,150,749 A 9/1992 Bergmann et al.
5,439,620 A * 8/1995 Maeda ..... 261/97
5,561,987 A * 10/1996 Hartfield et al. ..... 62/471
5,588,596 A 12/1996 Hartfield et al.
5,839,294 A * 11/1998 Chiang et al. ..... 62/471
5,893,410 A 4/1999 Halbrook
6,167,713 B1 1/2001 Hartfield et al.
6,293,112 B1 * 9/2001 Moeykens et al. ..... 62/84

* cited by examiner

*Primary Examiner*—Terrell McKinnon
(74) *Attorney, Agent, or Firm*—William J. Beres; William O'Driscoll

(57) ABSTRACT

An improved two-phase refrigerant distributor for use in a falling film evaporator in a refrigeration chiller system defines apertures in its undersurface from which serrated collars depend. The serrations cooperate to define locations below the undersurface of the distributor to which liquid refrigerant is drawn prior to exiting the distributor. As a result, the hang-up and/or travel of liquid refrigerant on the distributor undersurface is reduced or eliminated.

21 Claims, 6 Drawing Sheets

FALLING FILM EVAPORATOR HAVING AN IMPROVED TWO-PHASE DISTRIBUTION SYSTEM

BACKGROUND OF THE INVENTION

The present invention relates to the distribution of a two-phase refrigerant mixture in the evaporator of a refrigeration system. More particularly, the present invention relates to improving the distribution of saturated two-phase refrigerant over and onto the tube bundle in a falling film evaporator used in a refrigeration chiller. With still more particularity, the present invention relates to the enhancement of a two-phase refrigerant distributor to address the significantly higher oil concentrations found in the two-phase refrigerant delivered into a falling film evaporator of a refrigeration chiller the compressor of which is of the screw type.

Environmental, efficiency and other similar issues and concerns have, in recent years, resulted in a need to re-think evaporator design in refrigeration chillers in view of making such evaporators more efficient from a heat exchange efficiency standpoint and in view of reducing the size of the refrigerant charge needed in such chillers. In that regard, environmental circumstances relating to ozone depletion and environmental warming have taken on significant importance in the past several years. Those issues and the ramifications thereof have driven both a need to reduce the amount and change the nature of the refrigerant used in refrigeration chillers. As a result, so-called falling film evaporators have begun to be used in refrigeration chillers.

While the use and application of evaporators of a falling film design in refrigeration chillers is beneficial, their design, manufacture and incorporation into chiller systems has proven challenging, particularly with respect to the need to uniformly distribute refrigerant across the tube bundles therein. Uniform distribution of the refrigerant delivered into such evaporators in a refrigeration chiller application is critical to the efficient operation of both the evaporator and the chiller as a whole and to reducing the size of the chiller's refrigerant charge without compromising chiller reliability.

Achieving the uniform distribution of refrigerant is also a determining factor in the success and efficiency of the process by which oil, which migrates into the evaporator, is returned thereoutof to the chiller's compressor. The efficiency of the process by which oil is returned from a chiller's evaporator affects both the quantity of oil that must be available within the chiller in the first instance as well as chiller efficiency. Oil return and the ability of a refrigerant distributor in a falling film evaporator to uniformly distribute liquid refrigerant across the tube bundle in a falling film evaporator are made more difficult where the amount of oil entrained in the refrigerant is high.

Exemplary of a recent design for a falling film evaporator which employs a two-phase distribution system is the system set forth in U.S. Pat. No. 6,167,713 assigned to the assignee of the present invention and incorporated herein by reference. While that design has proven successful, it has been found that still further performance and efficiency improvements are possible, particularly where such distribution systems are employed in chiller systems where the oil circulation rate is relatively high.

In that regard, it has been found that because the vapor that issues out of the apertures on the underside of the refrigerant distributor in the falling film evaporator of the '713 patent does so at low velocity, there is relatively little disruption of the liquid refrigerant droplets that flow through those same apertures. As a result of that circumstance, some of the liquid refrigerant that exits the distributor may cling or hang onto the bottom surface of the distributor rather than fall directly downwardly onto the underlying tube bundle.

Liquid refrigerant droplets which cling to or hang onto the bottom face of the distributor can be driven across the undersurface of the distributor by the vaporized refrigerant gas that likewise exits the apertures in the bottom face of the distributor as that gas travels along the undersurface of the distributor enroute out of the evaporator. This can lead to maldistribution of the liquid refrigerant onto the underlying tube bundle or cause it to become entrained in the refrigerant vapor which flows from the evaporator to the chiller's compressor. If too much liquid refrigerant becomes entrained in such vapor, system efficiency and compressor reliability can be significantly affected.

Where a refrigerant distributor of the type disclosed in the '713 patent is employed in chiller systems in which a relatively small amount of oil is entrained in the refrigerant which is delivered into the distributor, it has been found that the hang-up of liquid refrigerant on the undersurface of the refrigerant distributor can be reduced by forming a downwardly depending collar around the apertures through which refrigerant issues from the distributor undersurface. However, where distributors of the type set forth in the '713patent are employed in chiller systems in which a relatively large amount of oil is entrained in the refrigerant that flows through the distributor, it has been found that the formation of such downwardly depending collars, of itself, may not reduce liquid refrigerant hang-up on the undersurface of the distributor to a sufficient degree.

In particular, it has been determined that the liquid refrigerant hang-up issue in chillers which employ compressors of the screw type can be significantly more severe than is the case in chiller systems of the type which employ centrifugal compressors. This is for the reason that the refrigerant gas discharged from screw compressors contains a relatively much larger amount of entrained oil then does the refrigerant gas discharged from compressors of other types, such as compressors of the centrifugal type.

The significantly higher oil concentration found in screw compressor based chiller systems results from the fact that oil is directly injected into the refrigerant undergoing compression within a screw compressor for multiple purposes, including sealing and cooling, whereas no such use of injected oil is made in centrifugal chiller systems. The increased concentration of oil found in the refrigerant that makes its way into the evaporator of a chiller system in which a compressor of the screw type is employed will therefore tend to have a higher concentration of oil in it, despite the upstream use of an efficient oil separator, and such mixture will have a greater tendency to adhere to the undersurface of the distributor in the falling film evaporator in such chiller systems.

The need therefore exists for an improved falling film evaporator for use in refrigeration chiller systems in which the refrigerant delivered into the chiller's evaporator contains a relatively large amount of entrained oil and for an improved refrigerant distributor which better achieves the uniform distribution of liquid refrigerant to the evaporator's tube bundle.

SUMMARY OF THE INVENTION

It is an object of the present invention to provide a falling film evaporator for use in a refrigeration chiller in which a two-phase mixture of refrigerant, in which oil is entrained, is more uniformly distributed into heat exchange contact with the evaporator's tube bundle.

It is still another object of the present invention to reduce liquid refrigerant maldistribution across the length and width of the tube bundle of a falling film evaporator by reducing the amount of liquid refrigerant that clings to the underside of the distributor therein and is instead caused to be deposited downward and onto the underlying refrigerant tube bundle at desired locations.

A still further object of the present invention is to reduce the entrainment of liquid refrigerant in the refrigerant gas that flows out of a falling film evaporator in a refrigeration chiller system by reducing the tendency of such liquid refrigerant to hang-up on the undersurface of the refrigerant distributor employed in the evaporator.

It is still another object of the present invention to enhance the efficiency of a falling film evaporator in a refrigeration chiller of the type employing a screw compressor by causing the liquid refrigerant droplets that issue from the refrigerant distributor within the evaporator to flow from the undersurface of the distributor in a pattern that better wets the surfaces of the underlying tube bundle.

Finally, it is an object of the present invention to improve refrigerant distribution in a falling film evaporator in a chiller system in which a screw compressor is employed by providing discrete points to which liquid refrigerant is drawn and collects, as a result of surface tension forces, prior to being delivered from the refrigerant distributor to the underlying evaporator tube bundle.

These and other objects of the present invention, which will become apparent when the following Description of the Preferred Embodiment and appended drawing figures are considered, are achieved by the disposition of a refrigerant distributor in the falling film evaporator of a refrigeration chiller which, by (1) the use of staged steps of distribution internal of the distributor, (2) the maintenance of essentially constant flow velocity in the refrigerant mixture in each of the initial stages of the distribution process, (3) the arrest of the mixture's kinetic energy in a final stage of distribution, prior to its issuance from the distributor, and (4) the direction and collection of liquid refrigerant to and at discrete points on the undersurface of the distributor results in the reduction of liquid refrigerant hang-up on the undersurface of the distributor, the expression of more uniform quantities of liquid refrigerant along the length and width of the evaporator's tube bundle, the improved wetting of the surfaces of the tube bundle and a reduction in the entrainment of such liquid droplets within the refrigerant vapor that flows out of the evaporator to the chiller's compressor.

Such more uniform distribution is achieved by first axially flowing the two-phase refrigerant mixture within the distributor through a passage the geometry of which maintains the flow velocity thereof essentially constant then flowing the refrigerant transversely internal of the distributor through passages of similar geometry which likewise maintains refrigerant flow therein at essentially constant velocity. The kinetic energy of the refrigerant is then absorbed, prior to its expression out of the distributor and into contact with the evaporator's tube bundle, in what can be categorized as a third stage of distribution internal of the distributor, so that the liquid refrigerant delivered out of the apertures defined in the undersurface of the distributor is in the form of relatively large, low energy droplets. Further, by the use of downwardly depending collars around the apertures through which liquid refrigerant is delivered out of the distributor that are specially configured to make use of the surface tension forces that exist within that liquid to draw the liquid to discrete collar locations, such oil-laden liquid refrigerant is better prevented from becoming entrained in the refrigerant vapor that flows out of the evaporator, is better prevented from clinging to and being driven along the undersurface of the distributor, is better directed to intended locations on the tube bundle and better wets the upper tube surfaces thereof.

DESCRIPTION OF THE DRAWING FIGURES

Figure 9A:
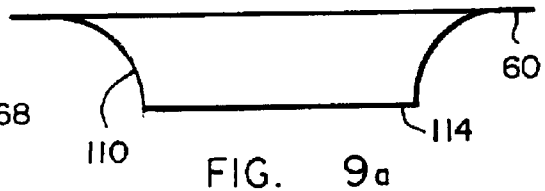
FIG. 9a (PRIOR ART)
Figure 9B:
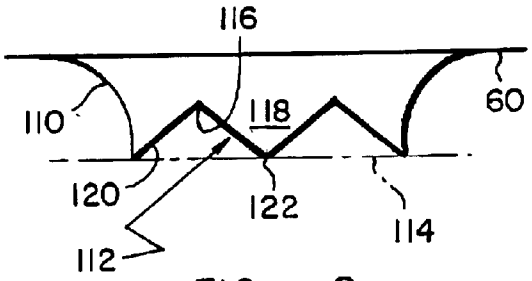

FIG. 9*a* illustrates a prior art collar geometry used in systems in which the amount of oil entrained in the two-phase mixture that enters the refrigerant distributor of FIGS. 4–7 is relatively low while FIG. 9*b* illustrates the improved collar arrangement of the present invention which is effective to collect and distribute liquid refrigerant droplets in which the concentration of oil is relatively high.

DESCRIPTION OF THE PREFERRED EMBODIMENT

Figure 1:
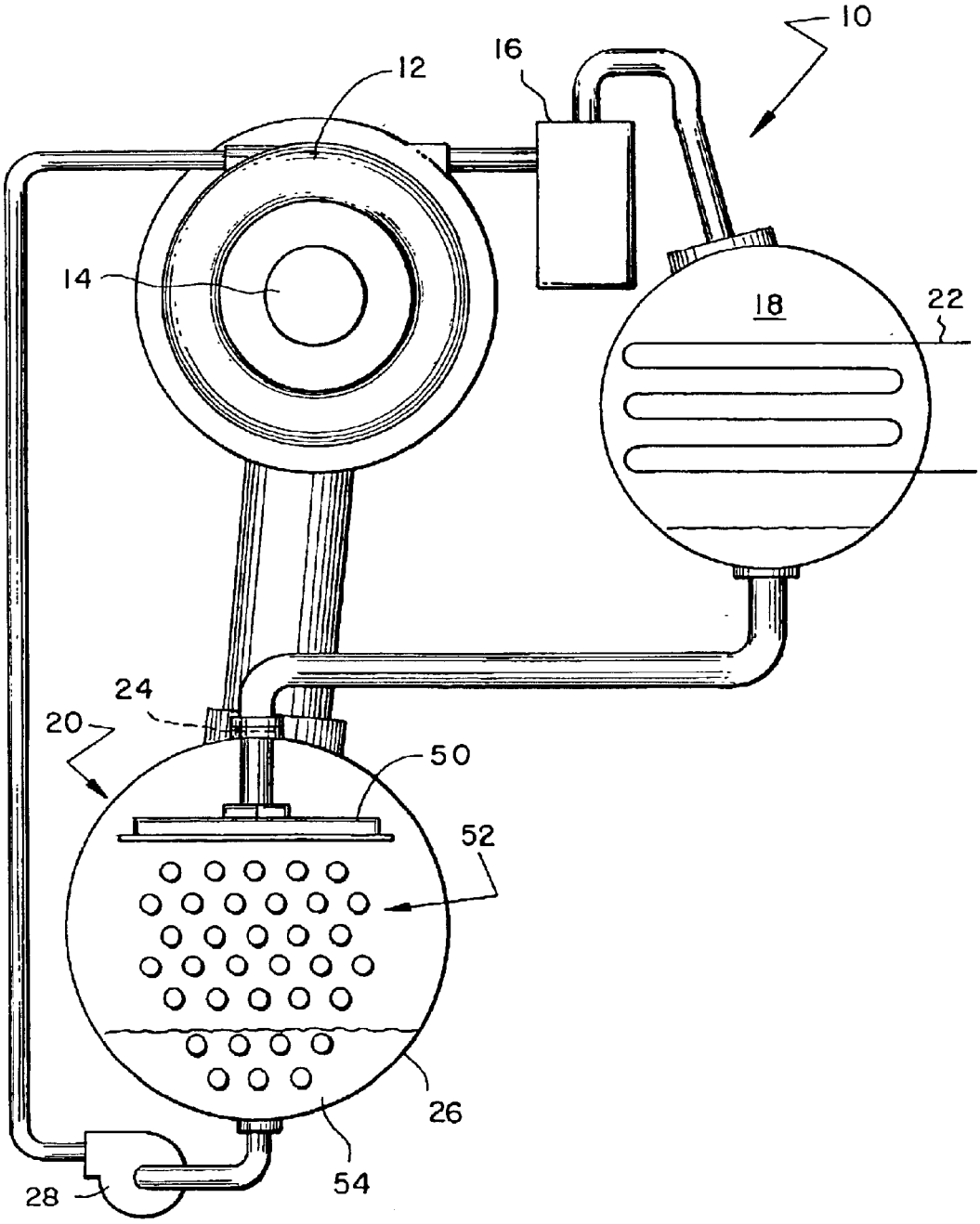
FIG. 1 is a schematic illustration of the water chiller of the present invention in which the falling film evaporator and the refrigerant distributor of the present invention are employed.

Referring first to FIG. 1, the primary components of chiller system 10 are a compressor 12, which is driven by a motor 14, an oil separator 16, a condenser 18 and an evaporator 20. These components are serially connected for refrigerant flow in a basic refrigerant circuit. Compressor 12 is, in the preferred embodiment, a compressor of the screw type.

Because of the nature of compressors of the screw type, a relatively large portion of the lubricant used within compressor 12 will be carried out of the compressor entrained in the high pressure gas stream that is discharged thereoutof. The portion of the lubricant which oil separator 16 fails to separate from the refrigerant gas flow stream is delivered into condenser 18 where it will fall or drain to the bottom of the condenser and make its way into the condensed refrigerant pooled there. The refrigerant pooled at the bottom of the condenser will have changed from the vapor to the liquid state as a result of its interaction with the relatively cooler fluid that flows through condenser piping 22. It is to be noted that while oil separators associated with the use of screw compressors in chiller systems are highly efficient, the amount of oil that makes its way past the oil separator to the system condenser in such systems is, nonetheless, higher than is the case in systems in which non-oil injected compressors, such as compressors of the centrifugal type, are employed.

The liquid pooled at the bottom of condenser 18 is driven by pressure out of the condenser to and through an expansion device 24 where a pressure reduction in the refrigerant occurs. This pressure reduction results in the creation of a two-phase refrigerant mixture downstream of the expansion device in which lubricant is entrained. As noted, the amount of entrained lubricant in screw compressor based chiller systems will be relatively much higher than will be the case in systems in which compressors of other types are employed. The two-phase refrigerant mixture flowing out of expansion device 24 and any lubricant flowing therewith is then delivered into evaporator 20.

As will more thoroughly be described, the uniform deposition of the two-phase refrigerant delivered from expansion device 24 into evaporator 20 along the length and across the width of tube bundle 52 within the evaporator results in the highly efficient vaporization of the liquid refrigerant portion of the mixture as it comes into heat exchange contact with the tubes in the evaporator's tube bundle. Such uniform deposition of liquid refrigerant also results in the flow of lubricant and a relatively small amount of liquid refrigerant, indicated at 54, to the bottom of the evaporator shell 26. The vapor portion of the two-phase mixture originally delivered from expansion device 24 into distributor 50, together with any vapor which may be newly formed therein or which is initially formed within shell 26 of the evaporator after issuing from distributor 50 in liquid form, is drawn upward and out of the upper portion of the evaporator and returns to compressor 12 for recompression therein in an ongoing process. The lubricant-rich mixture 54 at the bottom of the evaporator shell is separately returned to the chiller's compressor by pump 28 or another motive device or method, such as by use of an eductor.

Figure 2:
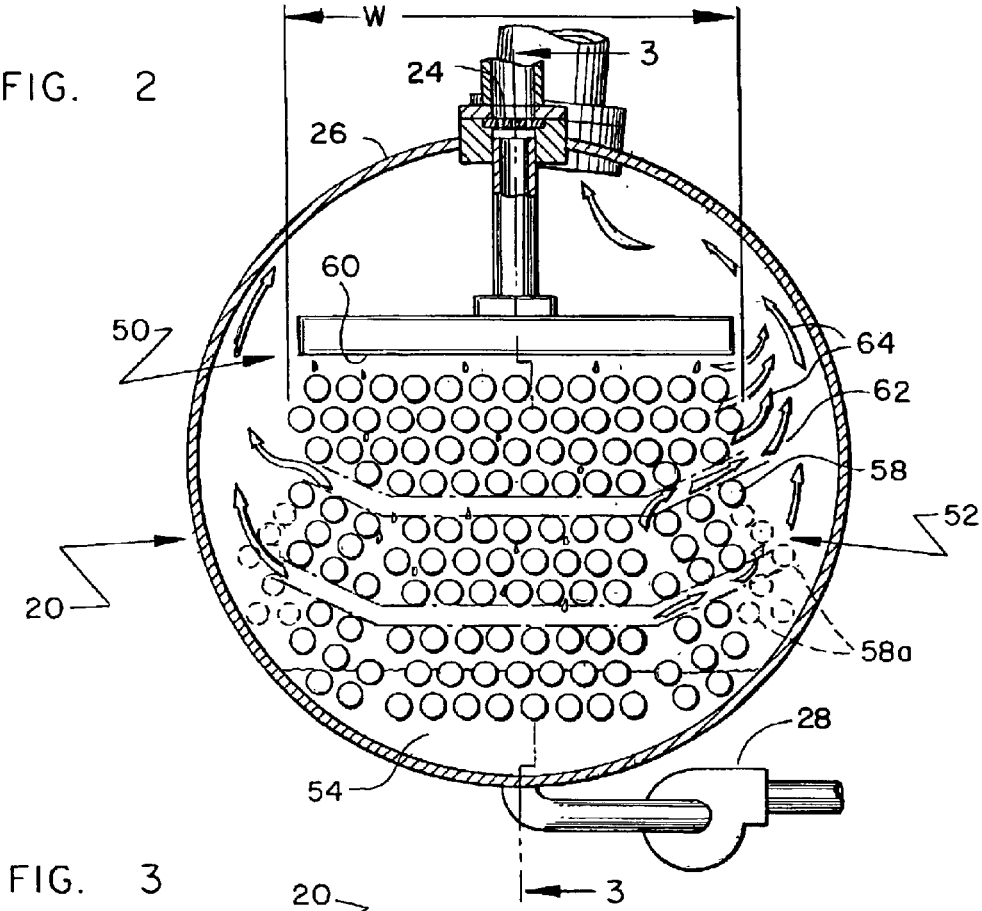
FIGS. 2 and 3 are schematic end and lengthwise cross-sectional views of the falling film evaporator of the present invention.
Figure 3:
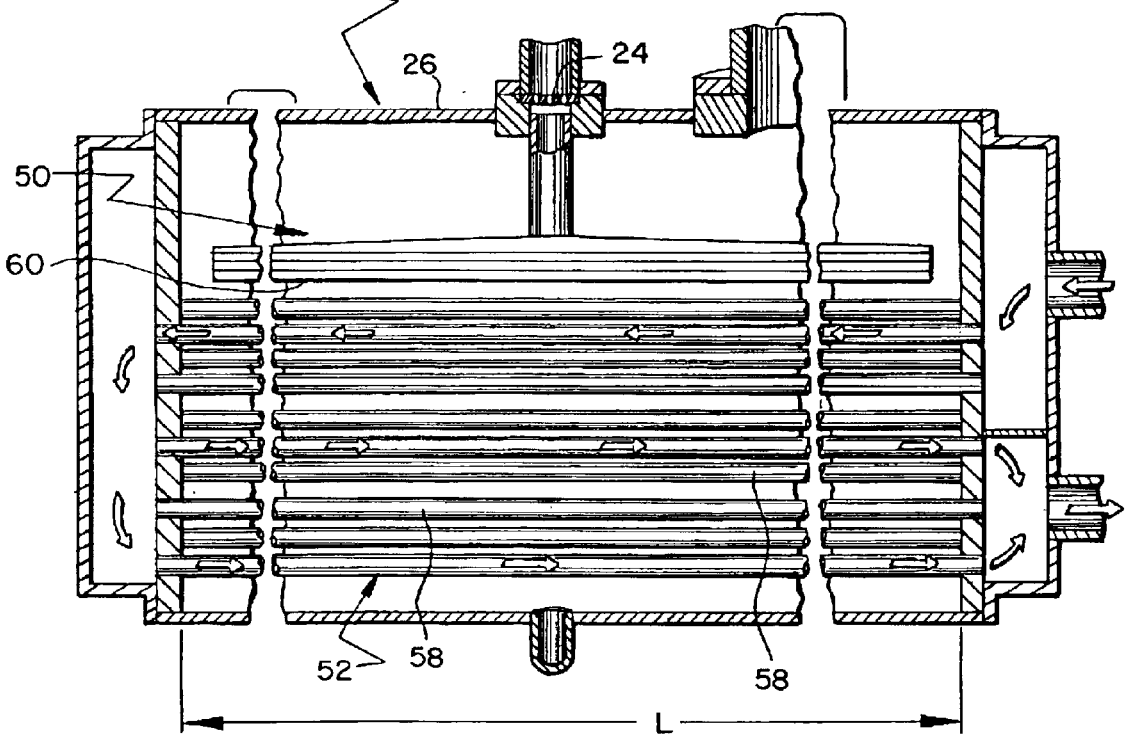
Figure 4:
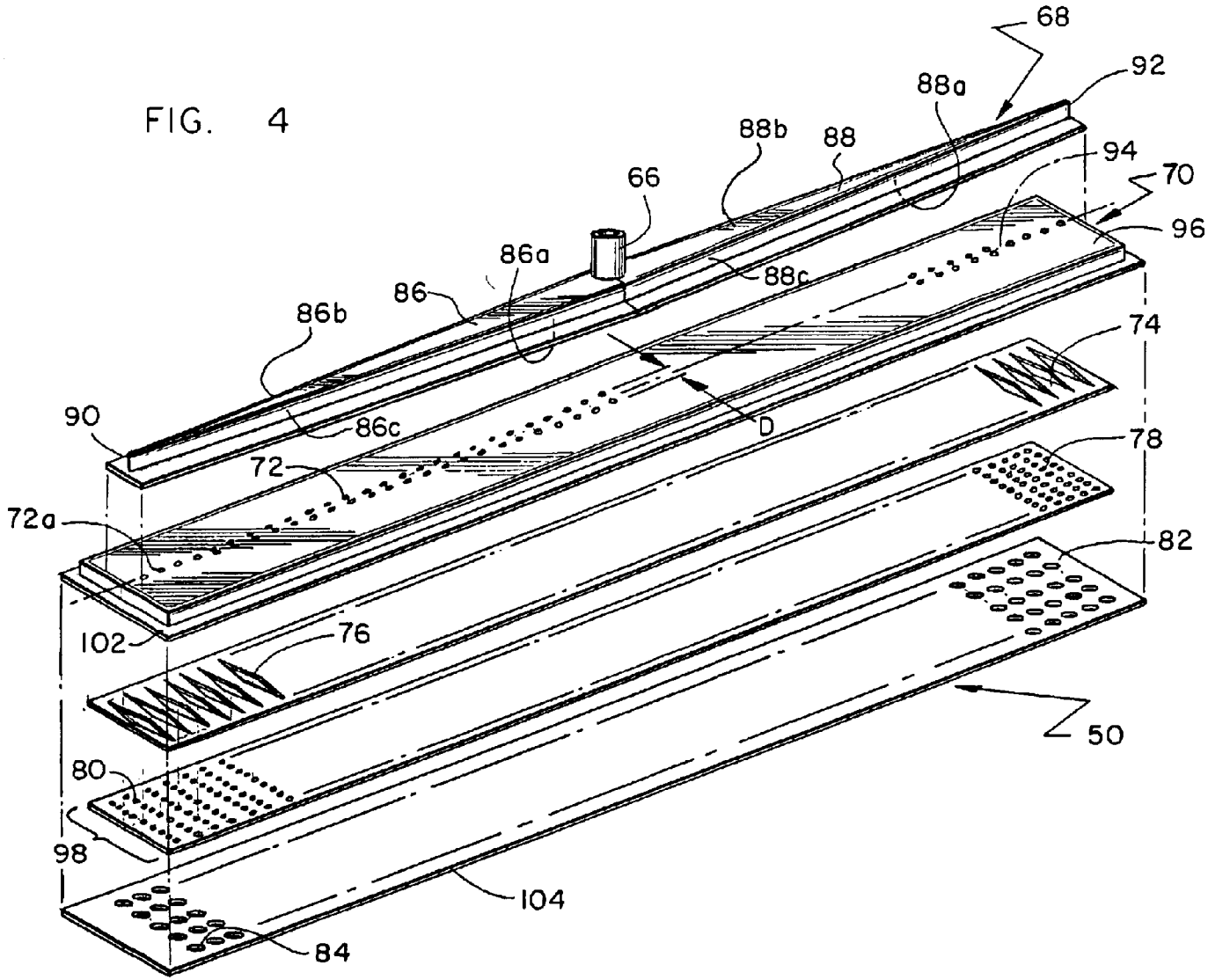
FIG. 4 is an exploded isometric view of the refrigerant distributor of FIGS. 1–3.
Figure 5:
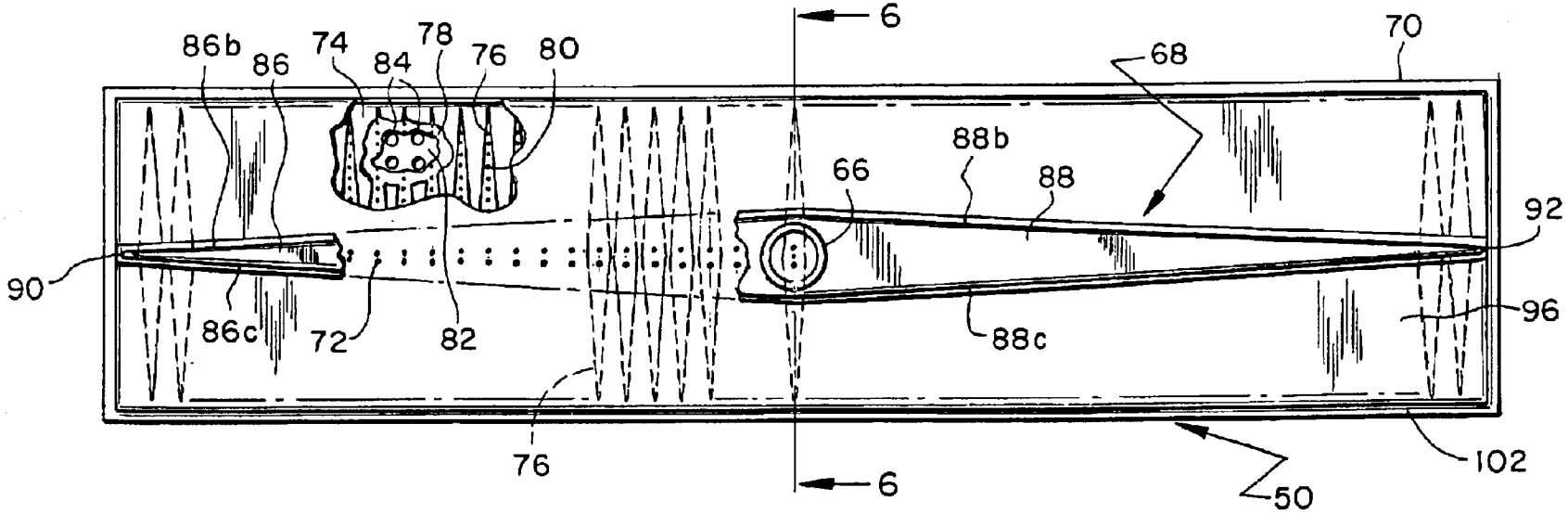
FIG. 5 is a top view of the refrigerant distributor of FIG. 4.
Figure 6:
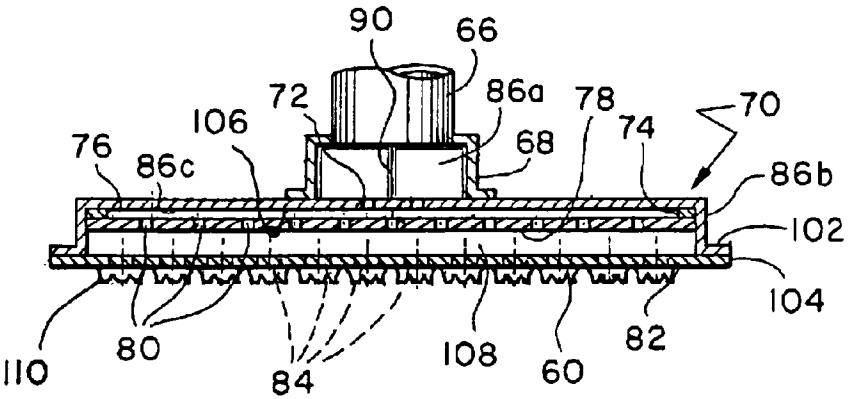
FIG. 6 is taken along line 6—6 of FIG. 5.

Referring additionally now to FIGS. 2 and 3, evaporator 20 and distributor 50 are schematically illustrated in end and lengthwise cross-sectional views thereof. As will be appreciated, refrigerant distributor 50 extends along at least the large majority of the length L and width W of at least the upper portion of tube bundle 52. Of course, the greater the extent to which the length and width of the tube bundle is overlain by distributor 50, the more efficient will be the heat exchange process within evaporator 20 as a result of the more productive use of the tube surface available in the evaporator for heat transfer purposes.

Tube bundle 52 is comprised of a plurality of individual tubes 58 which are positioned in a staggered manner under distributor 50 to maximize contact with the liquid refrigerant that, as will more thoroughly be described, is expressed out of undersurface 60 of distributor 50 onto the upper portion of the tube bundle. It is to be noted that at least some tubes 58*a*, shown in phantom in the lower portion of the tube bundle, may reside outside of the width W of the upper portion of tube bundle 52 since, by appropriate tube staggering, the downward and outward trickling of liquid refrigerant through the tube bundle, can be effected.

In addition to the liquid refrigerant that issues from distributor 50 and as noted above, at least some refrigerant gas will be expressed directly out of distributor 50 and will make its way from the area immediately underneath distributor 50 into the upper portion of the evaporator. With respect to refrigerant vapor created by the heat exchange that occurs between the relatively cool liquid refrigerant that flows onto and downward through tube bundle 52 and the heat load carried by the fluid flowing through the tubes 58 of the tube bundle, so-called vapor lanes 62 can be defined within the tube bundle itself through which refrigerant which is vaporized by contact with tubes within the tube bundle is conducted to the outer periphery thereof. From the outer periphery of the tube bundle, such vaporized refrigerant passes upward and around distributor 50, as indicated by arrows 64. That refrigerant, together with any refrigerant gas that is expressed directly out of distributor 50, flows into the upper portion of the evaporator and is then drawn out of evaporator 20 into compressor 12.

Referring additionally now to FIGS. 4, 5, 6, 7 and 8, distributor 50 includes: an inlet pipe 66; a first stage distributor section 68, which overlies a cover portion 70 in which stage one injection holes 72 and 72*a* are defined; a second stage distributor plate 74, which defines a plurality of individual diamond-shaped slots 76 and overlies a stage two injection plate 78 in which stage two injection holes 80 are defined; and, a bottom plate 82 in which stage three distribution apertures 84 are defined. First stage distributor section 68, in the preferred embodiment, has two branches 86 and 88 into which the two-phase refrigerant received through inlet 66 is directed.

Figure 7:
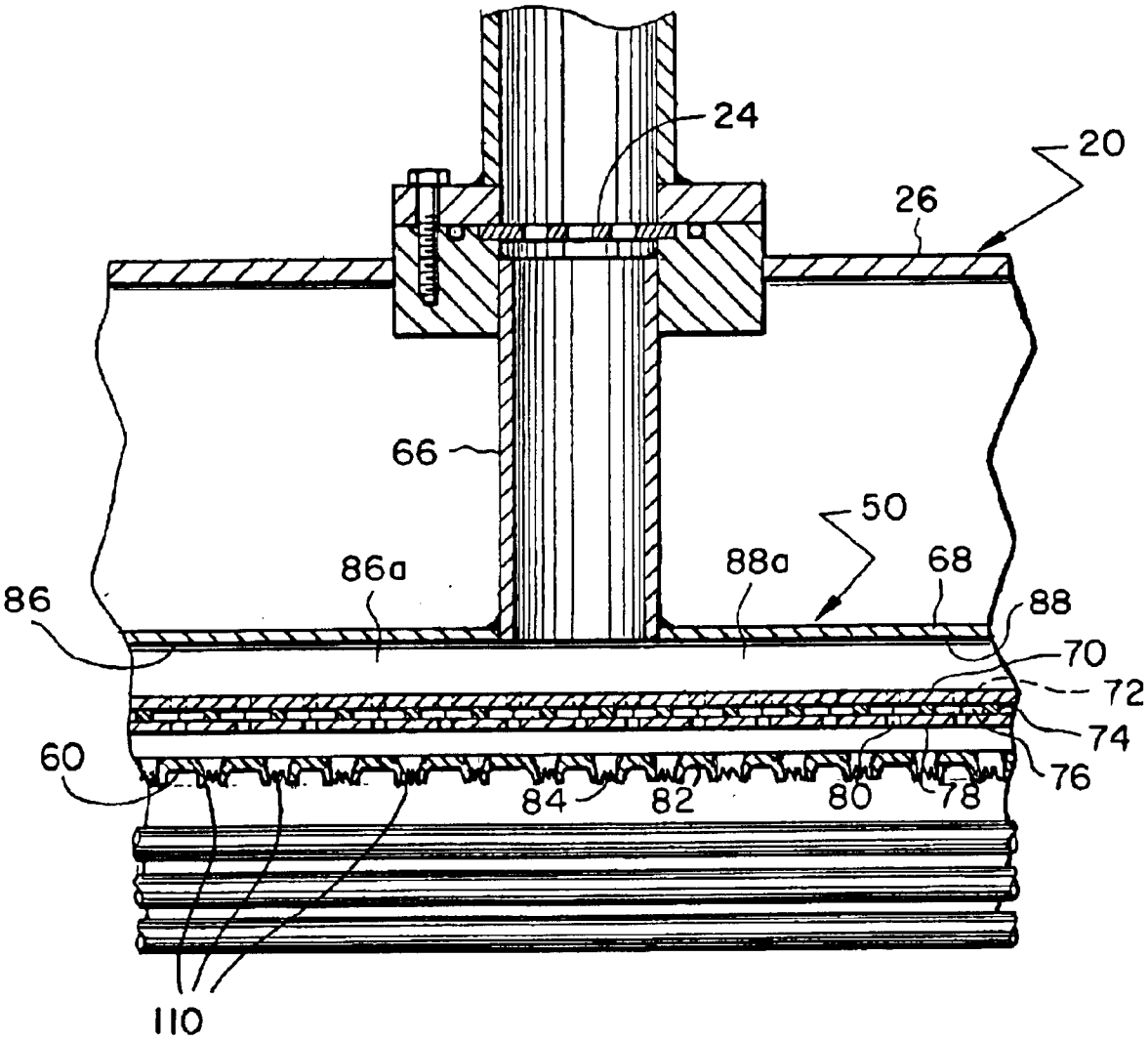
FIG. 7 is an enlarged sectional view of the upper portion of the evaporator of the present invention illustrating the disposition of an expansion device in that location.

Referring in particular to FIG. 7, it is to be noted that by virtue of the fact that expansion device 24 is disposed proximate inlet 66 of distributor 50, it advantageously acts not only to expand the refrigerant delivered to it from the condenser and cause cooling and a pressure drop therein but to preclude the stratification of that mixture by phase prior to its entry into the distributor. By locating expansion device 24 proximate inlet pipe 66 of distributor 50, any stratification in the refrigerant mixture that might otherwise occur if the distance between the expansion device and refrigerant distributor were greater is reduced or prevented. Consequently it is assured that a refrigerant mixture of a consistent and generally homogenous nature is delivered to the inlet of the distributor which significantly enhances the efficiency of distributor 50 with respect to its refrigerant distribution function.

Branch passages 86*a* and 88*a* of distributor 50, which are defined by branches 86 and 88 of first stage distributor section 68 and plate 70, are preferably but need not necessarily be rectangular in cross-section with the cross-sectional area thereof decreasing in a direction away from inlet 66. It is to be noted that although branches 86 and 88 and branch passages 86*a* and 88*a* are illustrated as being equal in length, they need not be, so long as refrigerant is appropriately apportioned to them in accordance with their individual volumes.

Terminal ends 90 and 92 of branches 86 and 88 are preferably pointed when viewed from above, with sides 86*b* and 86*c* of passage 86 and sides of 88*b* and 88*c* of passage 88 converging at those ends, though it is to be noted that the use of blunt rather than pointed ends may increase the ease of distributor fabrication. In sum, passages 86*a* and 88*a* of branches 86 and 88 are preferably configured to be of continuously decreasing cross section in a direction away from inlet 66. The general nature of such configuration and flow therethrough is described in U.S. Pat. No. 5,836,382, assigned to the assignee of the present invention and incorporated herein.

Branch passages 86*a* and 88*a* overlie stage one injection holes 72 and 72*a* of plate 70. Injection holes 72 run essentially the entire axial length of cover portion 70, along the axial centerline 94 of top face 96 thereof. As is illustrated, injection holes 72 run in pairs for the majority of the length of cover portion 70. In the preferred embodiment, the distance D between individual pairs of injection holes decreases in a direction away from inlet 66 to the branch passages, generally in conformance with the decreasing cross-sectional area of the branch passages 86*a* and 88*a*. Single injection holes 72*a*, disposed generally on centerline 94 of cover portion 70, will preferably be found at the axial ends of cover portion 70 where passages 86*a* and 88*a* are in their final stages of convergence.

Individual pairs of injection holes 72 and/or single injection holes 72*a* each overlie a diamond-shaped cutout 76 in second stage distributor plate 74. As will be appreciated from the drawing figures, second stage distributor plate 74 may fit up within cover portion 70 so that the two-phase refrigerant that is forced by pressure through injection holes 72 and 72*a* flows into the associated individual diamond-shaped slots 76 that are defined by plate 74.

Slots 76, are, in essence of the same nature and effect as branch passages 86*a* and 88*a* of the first stage portion of the distributor in that they define, together with cover portion 70 and stage two injection plate 78, individual flow passages which are of generally the same four-sided, rectangular nature which decrease in cross-section in a direction away from where refrigerant is received into them. Diamond-shaped slots 76 run, however, in a direction transverse of centerline 94 of plate-like member 70, as opposed to the axial orientation of branch passages 86*a* and 88*a* of the first stage distributor portion, so as to effectuate the even distribution of two-phase refrigerant across the transverse width W of the tube bundle. In sum, the flow path defined by the second stage of distribution is, in the preferred embodiment, comprised of a plurality of individual passages, each of which decrease in cross-sectional area in a downstream flow direction and each of which are in flow communication with at least one of holes 72 and/or 72*a* and at least one, and preferably several of holes 80.

It is to be appreciated that initial axial distribution of the incoming refrigerant mixture within distributor 50 followed by transverse distribution across its width is contemplated and preferred but that initial transverse followed by axial distribution is possible. It is also to be appreciated that slots 76 need not be diamond-shaped although they will generally be of some converging shape in a downstream direction.

Stage two injection plate 78, in which stage two injection holes 80 are formed, may fit up within cover portion 70 against second stage distributor plate 74 such that diamond-shaped slots 76 of second stage distributor plate 74 each overlie one transversely oriented row 98 of stage two injection holes 80 defined in stage two injection plate 78.

Figure 8:
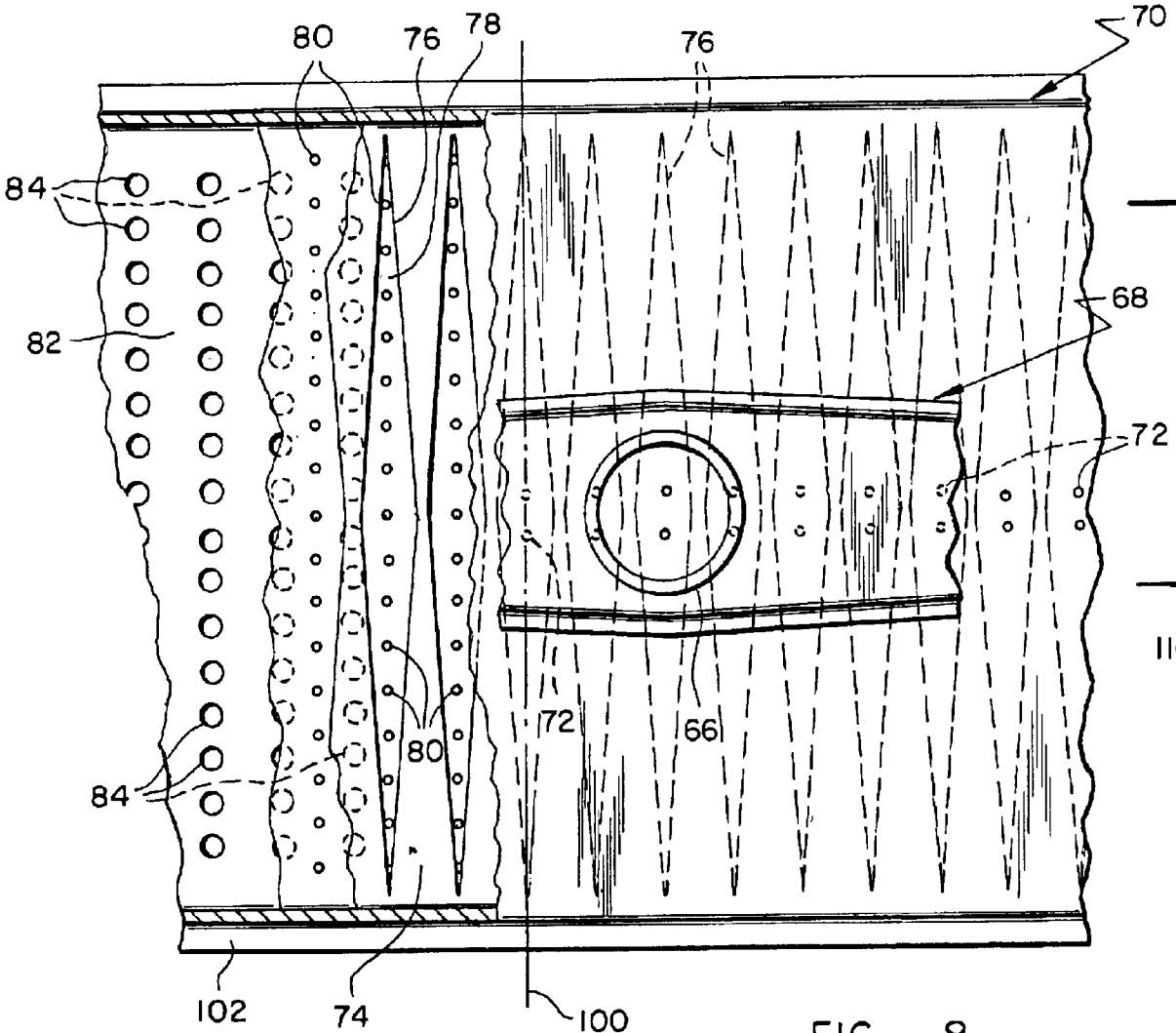
FIG. 8 is an enlarged partial cutaway view of a portion of FIG. 5.

As will be appreciated from Drawing FIG. 8, the positioning of stage one injection holes 72 and 72*a* of cover portion 70, diamond-shaped slots 76 of second stage distributor plate 74 and stage two injection holes 80 of second plate-like member 78 are preferably such that all of injection holes 72 and 72*a* and stage two injection holes 80 lie on the axis 100 of the diamond-shaped slot 76 with which they are associated. It will also be noted, however, that stage one injection holes 72 and 72*a* are preferably located so as not to directly overlie any of stage two injection holes 80. Further and as will more thoroughly be described, stage three distribution apertures 84, in addition to being relatively large-sized, have downwardly depending specially configured collars disposed around them and are preferably aligned/positioned such that none of stage two injection holes 80 directly overlie them.

With respect to bottom plate 82 of distributor 50, its peripheral edge portion 104 may fit up into flush contact with flange portion 102 of cover portion 70 and is attached thereto, such as with an adhesive or by welding, so as to ensconce members 74 and 78 between itself and cover portion 70. Second stage distributor plate 74 may fit up flush against undersurface 106 of cover portion 70 and second plate-like member 78 may fit up flush against plate 74. These two elements are there retained, likewise by use of an adhesive or by spot welding, so as to create stage three distribution volume 108 within the distributor in which, by virtue of the deposition of liquid refrigerant out of the stage two injection holes onto the upper surface of bottom plate 82 prior to its flow to apertures 84, the kinetic energy of the refrigerant is very significantly reduced.

Further with respect to bottom plate 82 and referring in particular now to Drawing FIGS. 6, 7, 9*a* and 9*b*, it will be appreciated that apertures 84 of bottom plate 82 have collars 110 formed circumferentially around them which depend downwardly from undersurface 60 of distributor 50. Whereas the prior art collars 110 of FIG. 9*a* have proven effective in systems in which the amount of oil entrained in the liquid refrigerant droplets that issue out of distributor 50 is relatively small, such collars have proven not to be as effective in the prevention of liquid refrigerant hang-up and the resulting maldistribution of liquid refrigerant onto the underlying tube bundle in refrigeration chiller systems in which the concentration of oil in such droplets is relatively high. The lesser ability of such collars to prevent the "wraparound" of such droplets onto undersurface 60 of distributor 50 or to deal with the hang-up thereon of refrigerant droplets in which a relatively large amount of oil is entrained results in part, from the higher surface tension forces associated with such liquid.

Referring specifically now to FIG. 9*b*, it has been found that by specially configuring the depending portions of collars 110, proactive use can be made of the increased surface tension forces that will be found in refrigerant in which a relatively large amount of oil is entrained to enhance liquid refrigerant distribution within evaporator 20, to reduce the entrainment of liquid refrigerant within the refrigerant vapor that exits evaporator 20 and to increase the efficiency of the heat exchange process within the evaporator. This is achieved by the better management and control of liquid refrigerant deposition onto the evaporator tube bundle that is achieved by the use of such specially configured collars.

To achieve such improvements, serrations 112 are formed along the lower edges 114 of collars 110 the result of which is to create discrete upper corner point locations 116 around the circumference of collars 110. Liquid refrigerant, in which a relatively high concentration of oil is entrained, is drawn to upper corner point locations 116 as it exits volume 108 of distributor 50. Such liquid is drawn to corner point locations 116, which are located below undersurface 60 and between the individual teeth 118 of collars 110, by the surface tension forces that exist within that liquid. The surface tension forces within that liquid increase in accordance with the amount of oil contained within it.

When a sufficient amount of liquid has collected at an upper corner point location 116 it will tend to flow downward, in droplet form, along an edge 120 of an adjacent tooth 118 and away from undersurface 60 of the distributor to the point 122 of such tooth. Preferably, the included angle between the edges 120 of adjacent teeth will be 120° or less. The flow of liquid along tooth edge 120 is as a result of gravity and the impetus generated by flow of refrigerant gas through the aperture 84 from which a collar depends.

The result of this process is the development of refrigerant droplets in a spaced array at teeth points 122 located around the lower edges of collars 110, away from the undersurface 60 of distributor 50, and a lessening of the ability of such liquid to wrap around collar 110 onto undersurface 60 and/or hang-up there. It is to be understood that while upper corner point locations 116 and teeth points 122 are referred to as "points" and preferably will be "points", the present invention does contemplate that these locations may have some degree of spacing, bluntness, curvature or the like so long as such spacing/bluntness/curvature is not so pronounced as to effectively prevent the creation and flow of refrigerant droplets as described.

The further effect of gravity and both the downward flow and issuance of refrigerant vapor out of the central portion of apertures 84 is to cause the refrigerant droplets arrayed around the lower edges 114 of collars 110 at teeth points 122 to be rained down onto the upper tubes of tube bundle 52 in a more dispersed, spray type pattern than was the case with previous unconfigured collars such as those illustrated in FIG. 9*a*. This additional and more predictable dispersal of liquid refrigerant droplets onto tube bundle 52, together with the better prevention of liquid "wrap around" and "hangup" on the undersurface 60 of distributor 50, is beneficial not only in reducing the maldistribution of liquid refrigerant onto the tube bundle and/or the entrainment of liquid refrigerant into the refrigerant vapor that flows to the system compressor but in the enhancement of the overall heat transfer performance of tube bundle 52 for the reason that the surfaces of the tubes in the upper portion of the tube bundle are better wetted.

It will be appreciated that by the use of serrated collars 110 in conjunction with bottom plate 82 of distributor 50 the enhanced and better managed downward flow of liquid refrigerant droplets out of the refrigerant distributor to intended and more dispersed locations on tube bundle 52 is achieved. Further, by the use of such serration and the resultant reduction in liquid refrigerant hang-up on the undersurface 60 of distributor 50, not only is improved and more uniform liquid refrigerant distribution across the tube bundle achieved but the amount of liquid refrigerant that becomes entrained in the refrigerant gas that flows out of the evaporator to the system compressor is reduced. The net effect is to increase overall evaporator and chiller system efficiency and to improve overall chiller and compressor reliability by reducing the amount of liquid refrigerant that is available to be drawn into the compressor.

Finally, it is to be noted that the use of such serrations and the results they achieve suggests the possibility of reducing the clearance between undersurface 60 of distributor 50 and the top surface of tube bundle 52. By doing so the further possibility and opportunity prospectively exists to reduce the overall diameter of the shell 32 in which tube bundle 52 is disposed which, in turn, would reduce both cost and the physical footprint of the evaporator and chiller system.

While the present invention has been described in the context of a preferred embodiment and alternatives and modifications thereto, it will be appreciated that many other alternatives and modifications to the invention will be apparent to those skilled in the art and fall within its scope. With that in mind, what is claimed is:

1. An improved falling film evaporator for use in a refrigeration chiller system comprising:

a shell;

a tube bundle disposed horizontally in said shell; and a refrigerant distributor disposed in said shell and overlying said tube bundle, said distributor having an undersurface in which a plurality of apertures are defined and from which a plurality of collars depend, at least one of said collars encircling at least one of said apertures, said at least one collar defining a first plurality of locations to which liquid refrigerant flowing through said at least one aperture is drawn by the surface tension forces in said liquid.

2. The evaporator according to claim 1 wherein said first plurality of locations are below said undersurface of said distributor.

3. The evaporator according to claim 2 wherein said at least one collar further defines a second plurality of locations, said second plurality of locations being disposed below said first plurality of locations, at least a portion of the liquid refrigerant drawn to said first plurality of locations flowing therefrom to said second plurality of locations and thence onto said tube bundle in droplet form.

4. The evaporator according to claim 3 wherein said first plurality of locations and said second plurality of locations are point locations and wherein said at least one collar defines a plurality of edges which connect said first plurality of point locations and said second plurality of point locations, the flow of liquid refrigerant from said first plurality of point locations to said second plurality of point locations being along said edges.

5. The evaporator according to claim 4 wherein the angle between adjacent ones of said edges is 120° or less.

6. The evaporator according to claim 1 wherein said first plurality of locations are disposed below said undersurface and said at least one collar defines a plurality of teeth, said first plurality of locations being disposed, one each, between adjacent ones of said plurality of teeth.

7. The evaporator according to claim 6 wherein said first plurality of locations are point locations and wherein said plurality of teeth are pointed, the points of said teeth being disposed physically below said first plurality of point locations.

8. The evaporator according to claim 7 wherein each of said teeth have at least two edges, said at least two edges of an individual tooth converging to the point of said tooth and each of said edges connecting the point of said tooth with one of said first plurality of point locations.

9. The evaporator according to claim 8 wherein the included angle between adjacent ones of said edges is 120° or less.

10. An improved distributor for distributing a two-phase, liquid-gas refrigerant mixture within a falling film evaporator comprising:

an inlet, said two-phase refrigerant mixture being received into said distributor through said inlet;

a first stage distributor portion, said first stage distributor portion receiving said two-phase refrigerant mixture from said inlet and defining a flow path for said two-phase refrigerant mixture which is generally oriented in a first flow direction;

a second stage distributor portion, said second stage distributor portion receiving said two-phase refrigerant mixture from said first stage distributor portion and defining a flow path for said refrigerant mixture which is generally oriented in a direction different from said first flow direction; and a third stage distributor portion, said third stage distributor portion receiving said two-phase refrigerant mixture from said second stage distributor portion and having an undersurface in which a plurality of apertures are defined, at least one of said apertures in said undersurface being encircled by a collar which depends downwardly from said undersurface, said collar defining a first plurality of locations to which liquid refrigerant in said two-phase refrigerant mixture is drawn and at which liquid refrigerant droplets initially form prior to exiting said distributor.

11. The distributor according to claim 10 wherein said first plurality of locations are below said undersurface of said distributor.

12. The distributor according to claim 11 wherein said at least one collar further defines a second plurality of locations, said second plurality of locations being below said first plurality of locations, at least a portion of the liquid refrigerant drawn to said first plurality of locations flowing therefrom to said second plurality of locations prior to exiting said distributor.

13. The distributor according to claim 12 wherein said first plurality of locations and said second plurality of locations are point locations.

14. The distributor according to claim 13 wherein said at least one collar defines a plurality of edges which connect said first plurality of point locations and said second plurality of point locations, the flow of liquid refrigerant from said first plurality of point locations to said second plurality of point locations being along said edges.

15. The distributor according to claim 14 wherein the angle between adjacent ones of said edges is 120° or less.

16. The distributor according to claim 10 wherein said first plurality of locations are disposed below said undersurface and said at least one collar defines a plurality of teeth, said first plurality of locations being disposed, one each, between adjacent ones of said plurality of teeth.

17. The distributor according to claim 16 wherein said first plurality of locations are point locations and wherein said plurality of teeth are pointed, the points of said teeth being disposed physically below said first plurality of point locations.

18. The distributor according to claim 17 wherein each of said teeth have at least two edges, said at least two edges of an individual tooth configuring to the point of said tooth and each of said edges connecting the point of said tooth with one of said first plurality of point locations.

19. The distributor according to claim 18 wherein the included angle between adjacent ones of said edges is 120° or less.

20. An improved method of distributing two-phase refrigerant within the falling film evaporator of a refrigeration chiller comprising the steps of:

disposing a horizontal tube bundle under a distributor within said evaporator;

delivering two-phase refrigerant into said distributor;

flowing said two-phase refrigerant within said distributor so as to position said mixture, internal said distributor, across the majority of the length and width of said tube bundle;

flowing the liquid portion of said two-phase refrigerant mixture to a plurality of apertures defined in the undersurface of said distributor and from which a plurality of collars depend;

drawing said liquid refrigerant which has flowed to said apertures in said flowing step to a first plurality of collar locations below said undersurface of said distributor;

initiating the formation of liquid refrigerant droplets at said locations; and depositing said liquid refrigerant droplets onto said tube bundle.

21. The method according to claim 20 comprising the further step of flowing refrigerant from said first plurality of collar locations to a second plurality of collar locations prior to said depositing step, said second plurality of collar locations being disposed below said first plurality of collar locations.

* * * * *